US007067754B2

(12) United States Patent
Weston et al.

(10) Patent No.: US 7,067,754 B2
(45) Date of Patent: Jun. 27, 2006

(54) BEZEL-BUTTON ASSEMBLY AND METHOD

(75) Inventors: Mark Weston, Brighton, MI (US); Stanley Dobson, Northville, MI (US)

(73) Assignee: Key Plastics, LLC, Northville, MI (US)

( * ) Notice: Subject to any disclaimer, the term of this patent is extended or adjusted under 35 U.S.C. 154(b) by 312 days.

(21) Appl. No.: 10/683,087

(22) Filed: Oct. 10, 2003

(65) Prior Publication Data

US 2005/0077154 A1 Apr. 14, 2005

(51) Int. Cl.
*H01H 9/00* (2006.01)

(52) U.S. Cl. ..... 200/314; 200/344

(58) Field of Classification Search ..... 200/5 R, 200/5 A, 296, 341–345; 341/22; 345/168
See application file for complete search history.

(56) References Cited

U.S. PATENT DOCUMENTS 3,551,630 A * 12/1970 Griffith ..... 200/295
3,961,145 A * 6/1976 Halbeck ..... 200/565
3,971,902 A * 7/1976 Wulf et al. ..... 200/5 A
4,004,120 A * 1/1977 Lee ..... 200/310
5,064,974 A * 11/1991 Vigneau et al. ..... 200/61.62
5,302,788 A * 4/1994 Link et al. ..... 200/401
5,720,379 A * 2/1998 Schwartz et al. ..... 200/318.1
5,739,486 A * 4/1998 Buckingham ..... 200/5 A
5,747,756 A * 5/1998 Boedecker ..... 200/5 A
5,756,947 A * 5/1998 Trimble et al. ..... 200/11 C
5,817,997 A * 10/1998 Wernig ..... 200/16 R
5,913,414 A * 6/1999 Pollock et al. ..... 200/316
6,102,394 A * 8/2000 Wurz et al. ..... 273/138.2
6,118,234 A * 9/2000 Marcellus et al. ..... 318/63
6,172,620 B1 * 1/2001 Brick et al. ..... 341/22
6,326,569 B1 * 12/2001 Ardrey et al. ..... 200/314
6,444,930 B1 * 9/2002 MacDonald et al. ..... 200/302.3
6,515,240 B1 * 2/2003 Krishna et al. ..... 200/5 R
6,542,353 B1 * 4/2003 Ardrey et al. ..... 361/660
6,590,174 B1 * 7/2003 Zysnarski et al. ..... 200/310
6,770,824 B1 * 8/2004 Faucher ..... 200/5 A

* cited by examiner

*Primary Examiner*—Lisa N. Klaus
(74) *Attorney, Agent, or Firm*—Markell Seitzman

(57) ABSTRACT

A bezel-button assembly comprising at least one button connected to a bezel. The button is moveable between a first position and at least a second position. An elastic layer connects the bezel to the button and is adapted to provide at least a partial mechanical bias of the button toward the first position. A method for forming a bezel-button assembly is also disclosed.

21 Claims, 5 Drawing Sheets

BEZEL-BUTTON ASSEMBLY AND METHOD

FIELD OF THE INVENTION

The present invention relates generally to a bezel including those with an integrated button.

BACKGROUND OF THE INVENTION

Switches and buttons are a part of everyday machine operation. Vehicle dashboards and other devices commonly include a multitude of switches and buttons for performing a multitude of operations. As a result, manufacturing of buttons and switches and their placement into the dashboards or other surfaces is a factor in the overall machine cost. Conventional manufacturing of buttons or other switch devices commonly incorporates a moveable button portion disposed in an outer shell or bezel, which surrounds the button. The bezel may provide an aesthetically pleasing or other suitable support surface while having the structure to allow a user to actuate the button. While such a system does allow buttons to operate within the bezel, some drawbacks may exist. For example, conventional manufacturing of button bezels typically requires multiple manufacturing steps to create the buttons and the bezel and then to assemble the buttons into the bezel. The present invention is developed in light of these and other potential drawbacks.

BRIEF SUMMARY OF THE INVENTION

The present invention comprises a button and bezel assembly including at least one button connected to a bezel. The button is moveable between a first position and at least a second position. An elastic layer connects the bezel to the button and is adapted to provide at least a partial elastic bias of the button toward the first (e.g., a "rest") position.

Other aspects of the invention will be apparent to those skilled in the art after reviewing the drawings and the detailed description below.

BRIEF DESCRIPTION OF THE DRAWINGS

The present invention will now be described, by way of example, with reference to the accompanying drawings, in which.

DETAILED DESCRIPTION OF THE INVENTION

Figure 1:
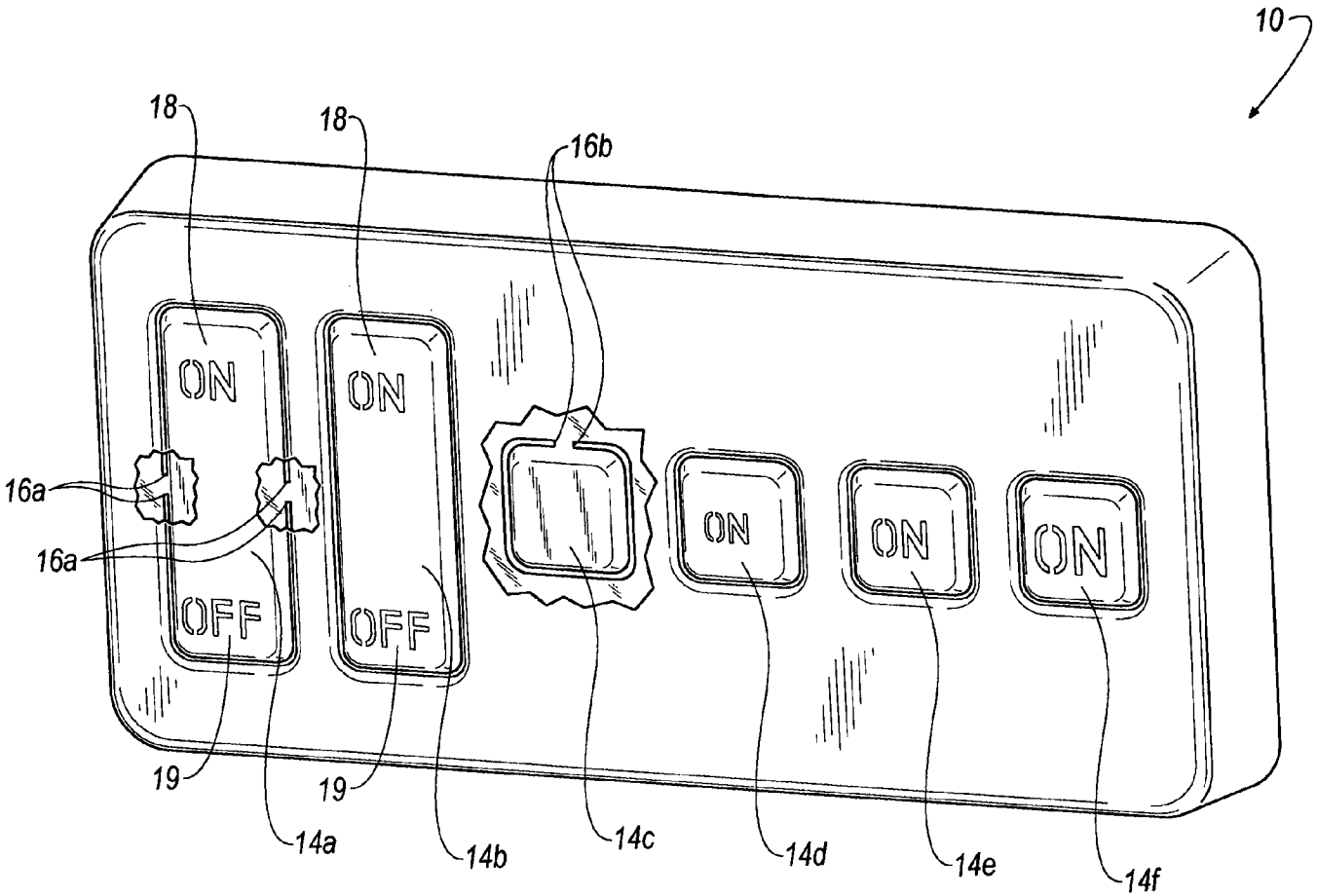
FIG. 1 is a perspective view of a top face of a bezel assembly according to an aspect of the present invention.
Figure 2:
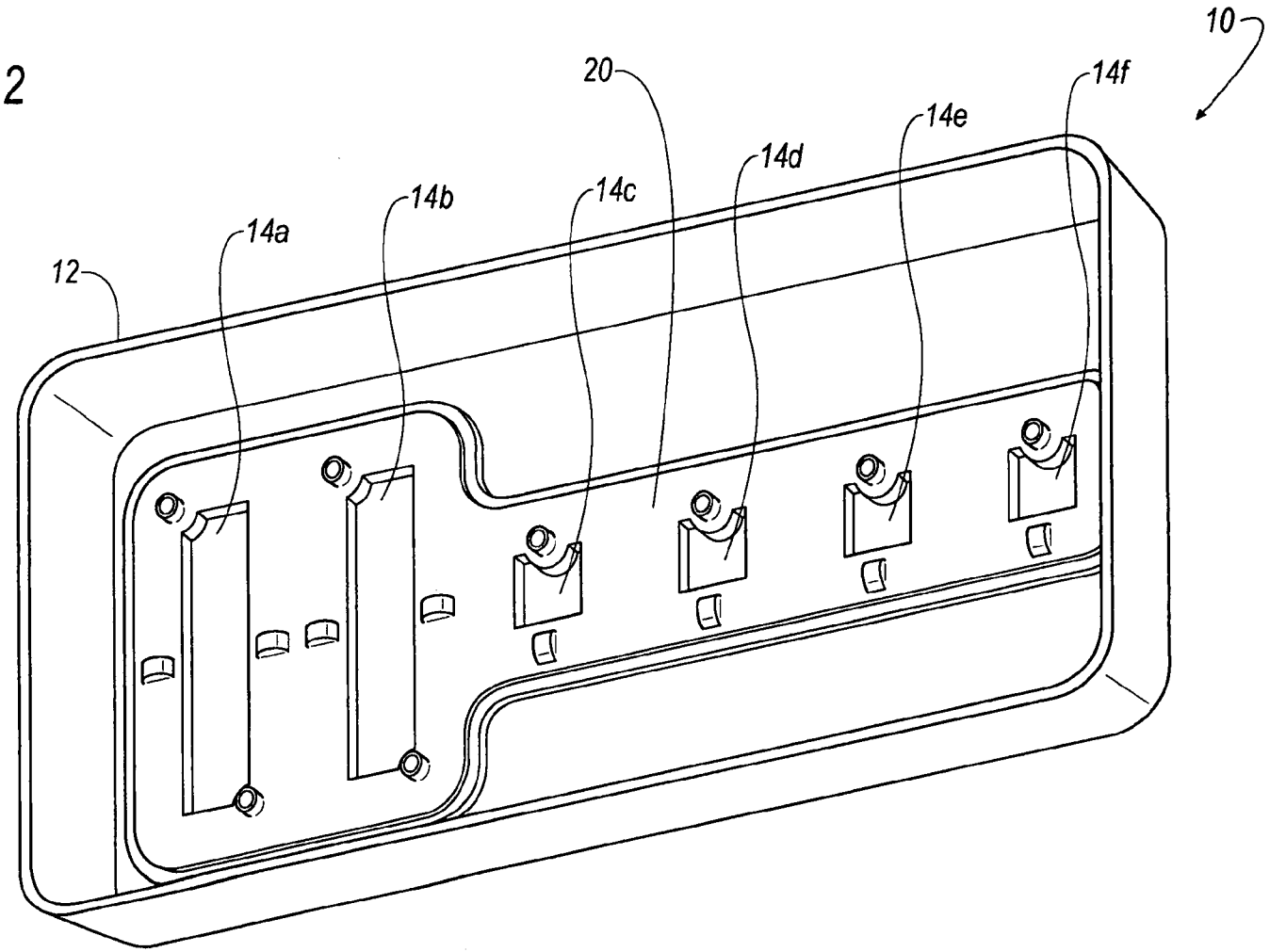
FIG. 2 is a perspective view of a rear face of a bezel assembly according to an aspect of the present invention.

Referring now to FIGS. 1 and 2, a button bezel assembly 10 is shown including a bezel portion 12; a plurality of buttons, for example 14*a*, 14*b*, 14*c*, 14*d*, 14*e* and 14*f*, that are disposed in the bezel portion 12; and a layer 20 attached or connected adjacent to bezel portion 12.

In an embodiment of the invention, one or more hinge members 16 may be integrally formed with the buttons 14 and bezel 12. For instance, each of the buttons 14 may be connected to the bezel portion 12 by hinge members, such as those illustratively represented as elements 16*a* and 16*b* in the cut-away segments of FIG. 1. It is however noted that multiple hinge member combinations (as shown) are not required. Moreover, hinge members are not required in all embodiments and may be eliminated from inclusion with respect the entire assembly or one or more buttons 14. Nonetheless, when present, the hinge members may serve the added purpose of retaining the buttons 14 in a desired position during the formation or attachment of layer 20 to the bezel 12 over or about the buttons 14. For instance, the hinge members 16 may, in addition to providing a hinge about which the buttons can move with respect to the bezel 12, they may, at least in part, be used to hold the buttons in a desired position during the formation of layer 20 over or about the button.

In an embodiment of the invention, such as that depicted in FIG. 1, some buttons (e.g., 14*a* and 14*b*) may be "rocker type" switches, while other buttons (e.g., 14*c*, 14*d*, 14*e*, and 14*f*) may be "push button" type switches. Of course, the associated button or buttons may be of any number or type and the present invention is not intended to be limited by the illustrative examples set forth herein.

With respect to embodiments including rocker type buttons, such as 14*a*, hinge members 16*a* may be positioned on opposite sides of the buttons, to provide a general axis to divide the button generally into upper portions 18 and lower portions 19. Such portions 18, 19 may be (such as with button 14*a*), but are not required to be, of similar dimensions. It is noted the "hinge members" or "hinges" are not limited to the type and sizes depicted in the exemplary illustrations. Further the hinge members may include or be comprised of pieces of integrally formed (or later added) connecting material between the buttons 14 and bezel 12, which permit the associated button to flex, rotate, or otherwise move in response to pressing upper portions 18 or lower portions 19 of the buttons. As a result, the buttons can be moveable between a first position and a second position. For example, the first position can be a "neutral" or an unpushed (or equilibrium) state while the associated second position may a position in which either the upper or lower portion is pushed into (or extends out of) the bezel 12. Of course, one skilled in the art will understand that variations of this may be used, such as having the first position be a pushed or actuated state while the second position is an unpushed or unactuated state.

Likewise, in the example shown, buttons 14*c*, 14*d*, 14*e* and 14*f* may also be connected to the bezel 12 by hinge members, such as those identified as 16*b* with respect to button 14*c*. Such hinge members can permit portions of the buttons (e.g., 14*c*–14*f*) to move into the bezel and/or rotate or flex about the associated hinge members. Buttons 14*c*–14*f* may also generally moveable between a first position and at least a second position. For example, without limitation, the first position can be an unpushed state while the second position take the form of a position in which the button is pushed into or meets a portion of the bezel. Of course, one skilled in the art will understand that variations of this may be used, such as having the first position a pushed state while the second position is an unpushed state.

In an embodiment of the invention, the material used to manufacture the bezel 12 and/or the buttons 14 may be comprised of rigid plastic such as a polypropylene, a teroplymer (e.g., acrylonitrile-butadiene-styrene, or ABS), or a nylon. Additionally, the bezel 12 and buttons 14 may be molded (i.e., injection, compression, etc.) together with a color material or dye disposed within the resin or molding material (as will be discussed in greater detail hereinafter). All or portions of the bezel 12 and/or buttons 14 may also be transparent or translucent to allow backlight to selectively pass therethrough. It should be understood however, that bezel 12 and buttons 14 are not limited to specific materials and may be formed of any suitable material, including, without limitation, metals, alloys, plastics, rubbers or other rigid material. It should be noted that hinge members 16 for all buttons 14 can be connected with or to any side or sides or surfaces of the associated buttons 14.

Referring further to FIG. 2, a layer 20 is disposed on a rear side of the bezel 12. It is noted that, the invention is not limited to such a configuration and other embodiments, discussed later herein, may in addition to or instead include a layer 20 disposed on the top side of the bezel 12. In the instant embodiment, layer 12 is bonded, adhered, or otherwise connected to the back side of bezel 12 and buttons 14. As depicted, layer 12 is connected to the back side of the bezel 12 such that the layer 20 substantially covers each button and may, as shown, cover a group of buttons.

In an embodiment of the invention, layer 20 is constructed of a flexible or elastomeric material that may elastically flex and/or deform and substantially return to form, i.e., an "elastic layer." Layer 20 provides at least some elastic resistance to movement of buttons 14 and button bezel 10 to at least partially bias the buttons 14 towards their first position, which may be an equilibrium position. As a result, once a button 14 is moved to a second position, layer 20 at least partially biases the repositioned or actuated button back to its first position. Material used to produce layer 20 may include, without limitation, thermoplastic elastomers (TPEs), EBS, TPO or any other suitable elastomeric material. Portions of either or both layer 20 and bezel 12 may also be translucent or transparent, or may be etched away or otherwise removed, to allow the bezel, hinge member, button, and/or associated button graphics to be illuminated or back lit. Alternatively, if desired for a given application, one or more of the foregoing components may instead be shaded or colored. In an embodiment of the invention, layer 20 covers substantially an entirety of the space between the buttons 14 and bezel 12 to generally fill gaps between buttons 14 and bezel 12 and, among other things, help seal out dirt or other material from passing or penetrating from one side of bezel 12 to the other.

In operation, pressing upper portion 18 causes button 14*a* to rotate or pivot about hinge member or members, e.g., 16*a*, into a second position. An upper portion 18 may move into the bezel 12 while lower portion 19 may move out of the bezel 12. Similarly, pressing buttons 14*c*, 14*d*, 14*e* or 14*f* can cause the respective buttons to move inward about hinge members 16*c*, 16*d*, 16*e* or 16*f*, respectively, from a first position to a second position. The portion of the button 14 that moves into the bezel 12 can cause an electrical and/or mechanical element or switch to make contact or otherwise interact with additional components to signal or perform an associated operation. Once the button 14 is no longer pushed, the elastic bias of layer 20 has a tendency, at least in part, to move or generally return the button substantially back to its first position. However, as will readily be understood by those of skill in the art, other components, such as a spring (e.g., element 26 in FIG. 5) or flexible structural component, may also be incorporated into the assembly to provide an additional means for returning a button to a desired position.

Figure 3:
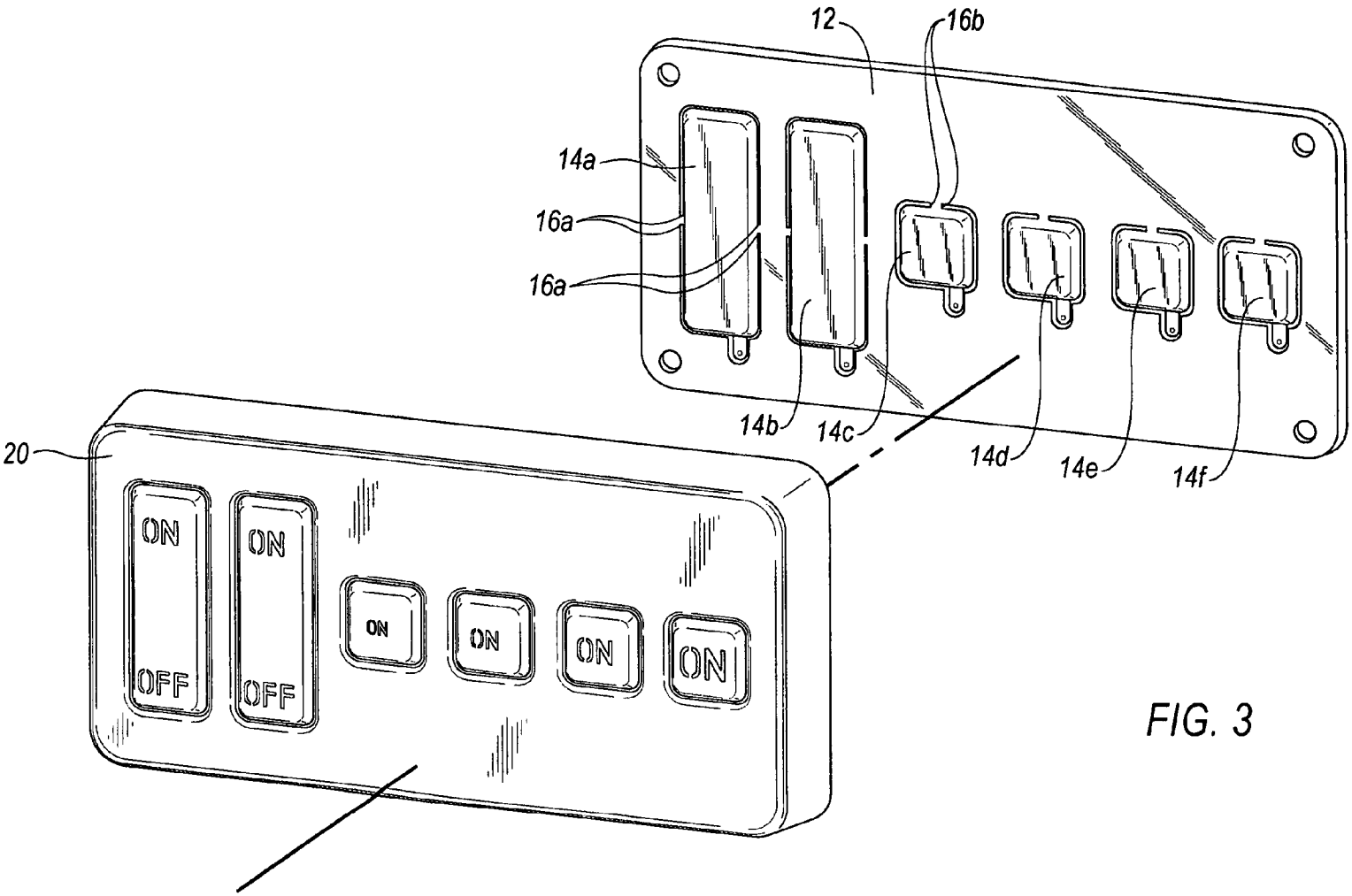
FIG. 3 is an exploded perspective view of a bezel assembly according to an aspect of the present invention.
Figure 4:
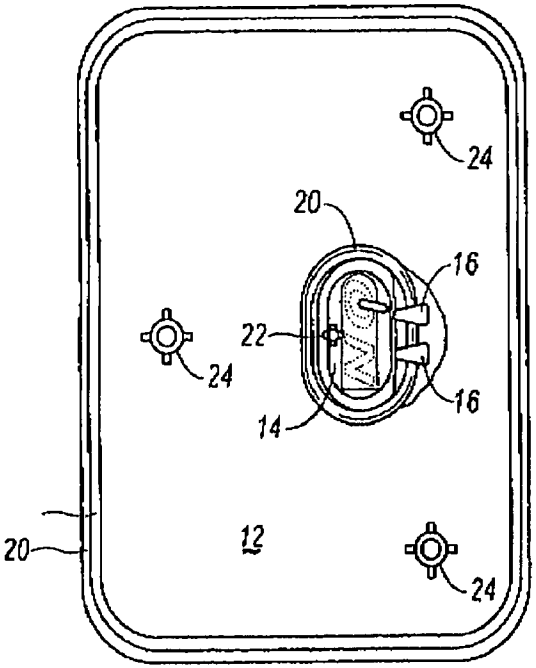
FIG. 4 is rear view of a bezel assembly according to an aspect of the present invention.

Referring now to FIGS. 3 and 4, other aspects of the invention are shown and described with respect to additional embodiments. In the assembly view of FIG. 3, a layer 20 is disposed on the top side of bezel 12. The layer 20 is bonded, attached or otherwise connected to portions of the outer surface of bezel 12 as well as the top side of one or more buttons 14. It should be understood that the layer 20 in connection with each of the various embodiments may cover varying amounts of the bezel 12 and the buttons 14, and does not need to completely encapsulate the bezel 12 or the individual or collective buttons 14. Instead, just enough connection between the bezel 12 and the buttons 14 is needed to allow the buttons 14 to be at least partially elastically biased by the layer and to cover or protect the space between the buttons 14 and the associated bezel 12 to the extent desired. However, it is recognized that for some applications complete encapsulation of an exposed surface of a bezel and associated buttons is desirable.

FIG. 4 depicts an example of a back side or bottom view of a simple single-button embodiment of the invention. In this embodiment, layer 20 is disposed on the top and sides of the bezel 12. As shown, the button 14 may be integrally connected to one or more hinge members 16. Depending upon the molding technique employed, layer 20 can completely or substantially surround the top surface and/or the sides of the button—i.e., around or about an associated hinge member 16 or, when no hinge member is present between the button and bezel, may help to function as a "living hinge" to support and permit movement of the button. With such configurations, the material of the layer 20 can work in conjunction with the hinge member 16 to help eliminate at least a portion of the mechanical stresses associated with the flexing, bending, or overpressing (or over extension) of the hinge member 16.

The button 14 can additionally include a formation 22, which may be integrally formed with the button 14 or may be a separate component in operable contact (electrical, magnetic, mechanical, etc.) with the button. When present, the formation can be used to support the button (e.g., to prevent over extension) and/or to interact with other components. For example, the formation can make contact with and translate a force or send a signal. Moreover, the bezel 12 may additionally include one or more bezel formations 24 that can be used to support the bezel and/or to connect or attach the bezel to other components, for example, a portion of a panel.

Figure 5:
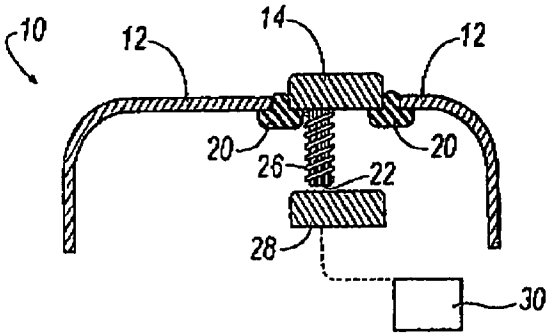
FIGS. 5, 6 and 7 are side cross sectional views of bezel assemblies according to aspects of the present invention.
Figure 6:
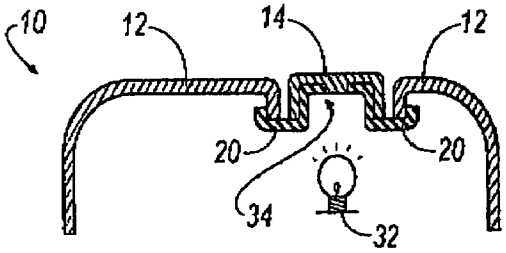
Figure 7:
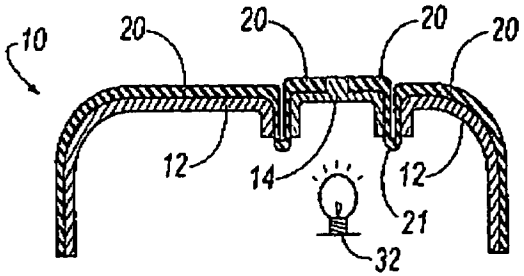

FIGS. 5, 6 and 7 illustrate cross sectional views of several embodiments of assemblies 10, along with some optional features. FIG. 5 depicts an embodiment in which the layer 20 generally surrounds a button 14 from the back or bottom side of the bezel 12. The illustrated button 14 includes an attached or integral formation 22 that is intended to contact another component 28 when the button 14 is depressed a given distance. If desired, the assembly may include a spring 26 or other formation to help return the button to an initial or other desired position. In the illustration, the formation may be used to contact or otherwise mechanically, electrically, or magnetically interact with the component 28 to send a force or signal (indicated by a dashed line) to another component 30, for example, a controller in a vehicle.

FIGS. 6 and 7 schematically represent embodiments in which portions of the buttons are "backlit" or otherwise illuminated. In the figures, the source of backlighting or illumination is schematically represented by a source 32. The source may be comprised of a bulb, fiber optics, or any other known components or means for conveying sufficient light or energy to desired portions of the associated layer, button and/or bezel.

In FIG. 6 the layer 20 is disposed on a portion of the back side or bottom portion of bezel 12. Conversely, FIG. 7 illustrates layer 20 disposed on a substantial portion of the top side of the bezel 12. In embodiments in which the layer is not transparent or translucent, the layer 20 may be kept from forming upon (e.g., by mold design) or may be removed from all or portions of the face of a button such that the light or energy provided by the source 32, when presented, can be externally perceptible. For instance, in an embodiment such as shown in FIG. 6, a portion of the layer 20, e.g., as indicated at 34, may be removed (e.g., by a laser) and, to the extent permitted by the material composition of the button, the energy or light provided by the source 32 will be perceptible.

Likewise, with respect to the embodiment shown in FIG. 7, the configuration may be designed such that the layer does not impede the desired external perception of the transfer of energy or light from the source 32. It should be noted that, as presented in the exemplary embodiment shown in FIG. 4, the layer may be configured such that desired words or symbols (there the word "ON") are presented to a user in connection with a button. Of course, as a matter of design, the words or symbols may be presented through portions of the bezel in addition to or instead of portions of associated buttons. Additionally, FIG. 7 further shows details of a living hinge 21. In FIG. 7 the layer 20 is formed into at least one loop which peripherally envelops the button and spans the space between the button and the bezel; the loop provides an added degree of freedom so as not to restrict the movement of the button.

Figures 8, 9:
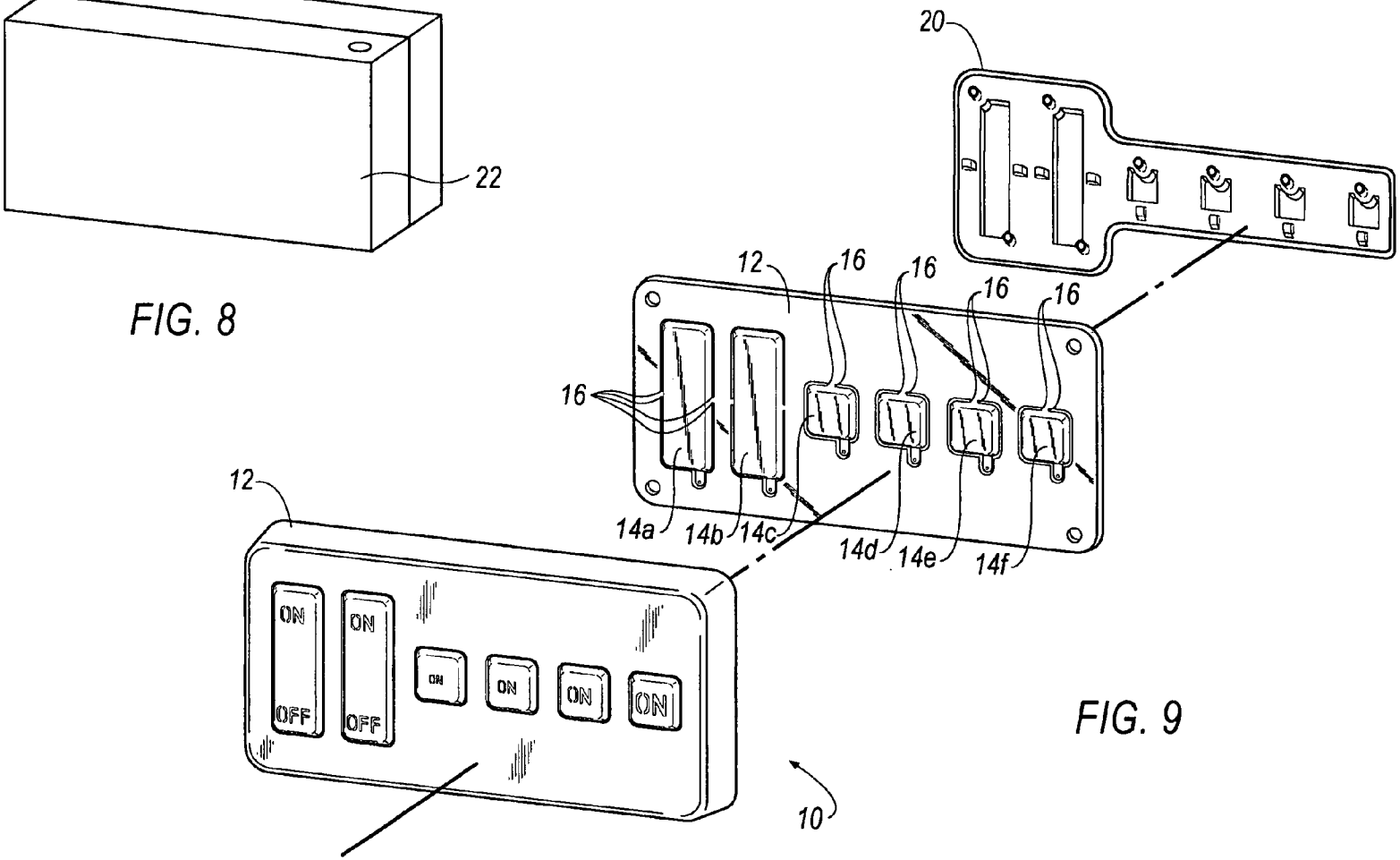
FIG. 8 is a generic representation of a mold set.
FIG. 9 is an exploded view generally illustrating the assembly of an embodiment of the present invention.

Referring to FIGS. 8 and 9, a method for creating button bezel 10 is generally described. FIG. 8 is a generic representation of a mold set—such as those used for injection or compression molding—that may be used to form just a portion of a bezel or a bezel and one or more buttons 14. The mold 22 may include cavities that are used to form the bezel 12 and buttons 14, and in some instances, the associated hinge members 16. In embodiments, such as that shown in FIG. 9, the bezel 12 and button 14 are integrally formed with and connected by one or more associated hinge members 16, which, if desired, can all be formed in one formation step or shot. For example, a hot material (such as a plastic) can be injected or compressed into the mold 22 to form features of the bezel 12, button 14 and the associated hinge member 16 (or other features intended to at least temporarily hold the button 14 in a desired position during subsequent formation of the layer 20).

In connection with the formation of the bezel 12, a second mold (not shown) or other molding process can be used to form the associated layer 20. In one particular embodiment, the second mold includes one or more cavities configured to form the contours, curves and configuration required to form layer 20 about all or a portion of the bezel 12. As a result, a "two-shot" type of process may be used to form the assembly 10. Depending upon the desired configuration, layer 20 may be formed on a top portion of the bezel, on a rear portion of the bezel, or both. Moreover, the heat associated with the formation of layer 20 may be used to effectuate bonding with corresponding portions of the associated bezel 12.

In other embodiments, such as the one generally illustrated in FIG. 9, the layer 20 can be initially formed apart from the bezel 12 and later connected to it. If desired, the layer 20 can be reheated, or while the layer 20 is still at a sufficient temperature, it can be attached or bonded to the appropriate side of the bezel 12. In instances in which there is added heat or residual heat associated with layer 20, the heat can cause, facilitate or assist with the attachment or bonding between the layer 20 and the associated bezel 12. It should be noted, however, that other methods of connecting layer 20 to bezel 12 may be used such as glue, adhesive, mating or connecting components or formations, or any other known means of connection.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. An assembly comprising:

a bezel;

at least one button connected to the bezel, the button being moveable between a first position and at least a second position relative to the bezel; the at least one button connected to the bezel via a hinge including a hinge member integrally formed as part of the bezel and button; the at least one button spaced from the bezel but for the hinge; and an elastic layer molded or bonded to at least a portion of the button and a portion of the bezel, the elastic layer elastically filling the space between the button and the bezel, the elastic layer configured to at least partially mechanically bias the button towards the first position.

2. The assembly as recited in claim 1, wherein the first position is defined as a position in which a portion of a top surface of the button is substantially flush with an adjacent portion of a surface of the bezel.

3. The assembly as recited in claim 1, wherein the first position is defined as a position in which a portion of a top surface of the button is recessed or proud with respect to a portion of a surface of the bezel.

4. The assembly as recited In claim 1, wherein the button includes sides and the elastic layer substantially covers the sides of the button.

5. The assembly as recited in claim 1, wherein:

the button and bezel have a top side and a back side; and the elastic layer is attached or bonded to at least a portion of the back side of the button, the bezel, or both the button and the bezel.

6. The assembly as recited in claim 1, wherein:

the button and bezel have a top side and a back side;

the elastic layer is attached or bonded to at least a portion of the top side of the bezel, the button, or both the button and the bezel.

7. The assembly as recited in claim 1, wherein a portion of the bezel, a portion of the button, or portions of both the bezel and the button are transparent or translucent.

8. The assembly as recited in claim 7, including a light source.

9. The assembly as recited in claim 1, further comprising:

a second hinge member disposed on an opposite side of the button from the hinge member such that the hinge member and the second hinge member define an axis of rotation for the button, the second hinge member integrally formed as part of the button and bezel.

10. The assembly as recited in claim 1, wherein the button includes an external formation.

11. The assembly as recited in claim 10, wherein the formation is in operable contact with the button.

12. The assembly as recited in claim 11, wherein the formation supports the button or interacts with other components to transfer a force or to convey a signal.

13. The assembly as recited in claim 1, including a means for supporting or biasing the button.

14. The assembly as recited in claim 13, wherein the means for supporting or biasing the button comprises a spring.

15. The assembly as recited in claim 1, wherein the layer is configured to at least partially support the hinge member.

16. The assembly as recited in claim 1, wherein the layer covers an area less than an entirety of a surface of the bezel.

17. An assembly as recited in claim 1, wherein the bezel includes at least one integral formation for attaching the bezel to a separate component or surface.

18. A button bezel comprising:

at least one button with a top and a back surface;

a bezel for supporting the button, the bezel having a front, top and back surface, the bezel integrally connected to the button; and a layer means that substantially covers a portion of the top or back surface of the button and an adjacent portion of the bezel and biases the button towards a first position.

19. The button bezel as recited in claim 18, wherein the button is configured to move between a first position and at least a second position.

20. The button bezel as recited in claim 19, wherein the second position is configured to transfer a force or a signal to another component.

21. The button bezel as recited in claim 18, wherein the layer means substantially seals at least a portion of a space between the button and the bezel.

* * * * *